US009421728B2

(12) United States Patent
Santandrea

(10) Patent No.: US 9,421,728 B2
(45) Date of Patent: Aug. 23, 2016

(54) APPARATUSES AND METHODS FOR COMPACTING WASTE

(75) Inventor: Marco Santandrea, Florence (IT)

(73) Assignee: ATOP S.p.A., Barberino Val D'Elsa, Florence (IT)

( * ) Notice: Subject to any disclaimer, the term of this patent is extended or adjusted under 35 U.S.C. 154(b) by 739 days.

(21) Appl. No.: 13/700,665

(22) PCT Filed: Oct. 21, 2011

(86) PCT No.: PCT/IB2011/054710
§ 371 (c)(1),
(2), (4) Date: Nov. 28, 2012

(87) PCT Pub. No.: WO2012/095706
PCT Pub. Date: Jul. 19, 2012

(65) Prior Publication Data

US 2013/0118363 A1 May 16, 2013

(30) Foreign Application Priority Data

Jan. 14, 2011 (IT) ..... PI2011A0001

(51) Int. Cl.
*B30B 9/14* (2006.01)
*B30B 9/18* (2006.01)
*B30B 11/24* (2006.01)
(Continued)

(52) U.S. Cl.
CPC . *B30B 9/14* (2013.01); *B02C 18/00* (2013.01); *B02C 18/0084* (2013.01); *B02C 18/2216* (2013.01); *B30B 9/124* (2013.01); *B30B 9/125* (2013.01); *B30B 9/18* (2013.01); *B30B 11/24* (2013.01); *B30B 13/00* (2013.01); *B30B 15/302* (2013.01); *B30B 15/32* (2013.01)

(58) Field of Classification Search
CPC ..... B30B 9/121; B30B 9/18; B30B 9/14; B30B 9/16; B30B 15/302; B30B 15/32; B30B 9/124; B30B 9/125; B30B 13/00; B30B 11/24; B01D 29/25; B01D 29/48; B01D 29/6476; B01D 29/828; B02C 18/00; B02C 18/0084; B02C 18/2216
USPC ..... 100/37, 43, 48, 117, 127, 145, 147, 100/148, 149, 73
See application file for complete search history.

(56) References Cited

U.S. PATENT DOCUMENTS 1,146,656 A * 7/1915 Rogers ..... B30B 9/3035 100/126
1,851,191 A * 3/1932 Lang ..... B30B 9/18 100/147

(Continued)

FOREIGN PATENT DOCUMENTS

DE 317 788 12/1919
ES 2047414 2/1994

(Continued)

*Primary Examiner* — Jimmy T Nguyen
(74) *Attorney, Agent, or Firm* — Ropes & Gray LLP

(57) ABSTRACT

An apparatus and a method for treating organic waste, like the waste that is eliminated in kitchens, foresee containing the waste (15) to be treated, grinding the waste, compacting the ground waste and exerting a squeezing action to remove residual liquids. A screw device (17) is foreseen which rotates inside a casing (18) around a longitudinal axis to convey and compact the ground waste against a closure (19) which moves during compacting. A solution for cleaning the apparatus is also foreseen to remove remaining any waste, when the apparatus needs to stay empty for longer periods of inactivity.

15 Claims, 6 Drawing Sheets

(51) Int. Cl.

| | |
|---|---|
| ***B30B 13/00*** | (2006.01) |
| ***B02C 18/00*** | (2006.01) |
| ***B02C 18/22*** | (2006.01) |
| ***B30B 9/12*** | (2006.01) |
| ***B30B 15/30*** | (2006.01) |
| ***B30B 15/32*** | (2006.01) |

(56) References Cited

U.S. PATENT DOCUMENTS 2,268,753 A * 1/1942 Kerr ..... B30B 9/12 100/148
5,061,366 A * 10/1991 Arai ..... B01D 29/25 100/117
5,389,347 A * 2/1995 Hall ..... A61L 11/00 100/149
2009/0211467 A1 8/2009 Flor

FOREIGN PATENT DOCUMENTS

| | | | | |
|---|---|---|---|---|
| FR | 2109731 | | 5/1972 | |
| FR | 2 607 515 | | 6/1988 | |
| IT | EP 2644575 | A1 * | 10/2013 | ..... B30B 9/124 |
| JP | 49-048883 | U | 4/1974 | |
| JP | 51-111776 | U | 9/1976 | |
| JP | 2005-66698 | | 3/2005 | |
| WO | WO 2010/011039 | | 1/2010 | |

* cited by examiner

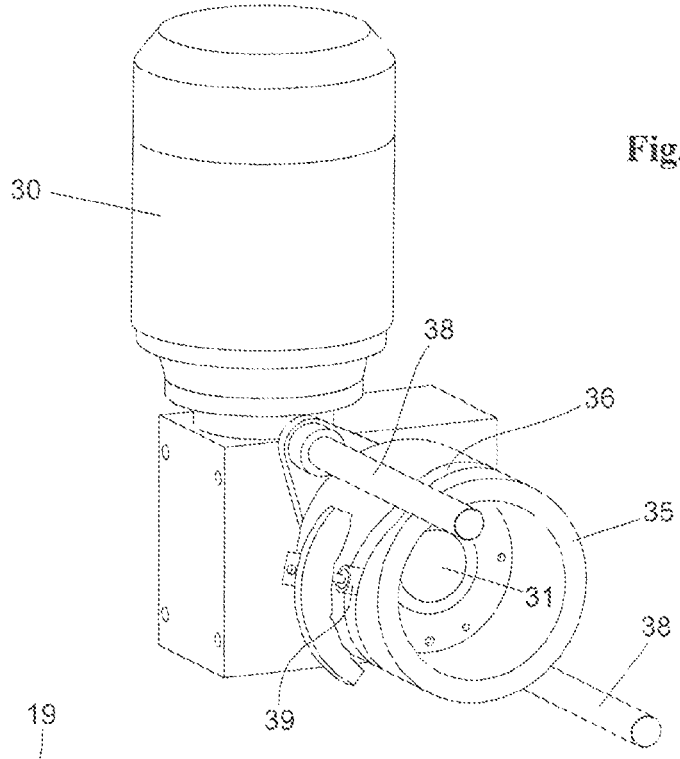
Fig. 3
Fig. 4
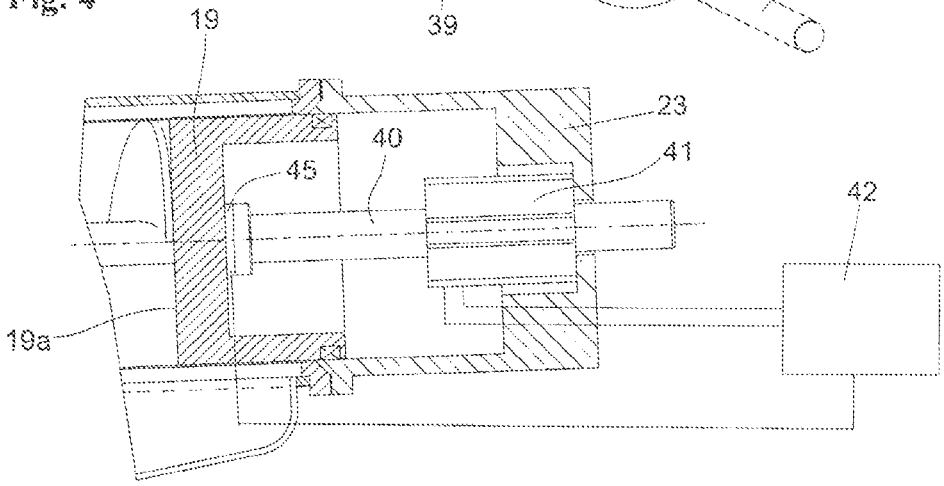
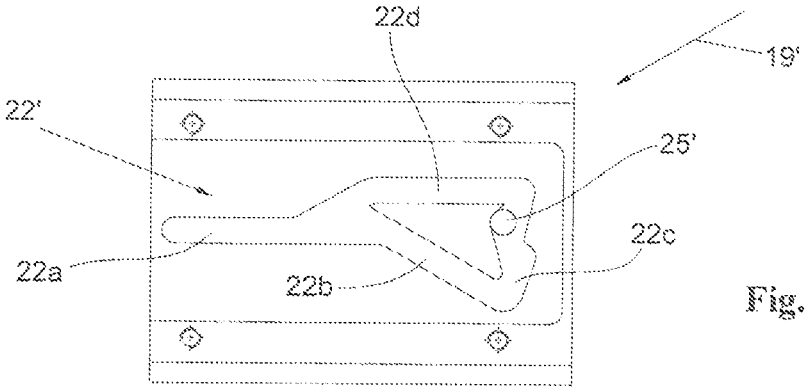
Fig. 5

APPARATUSES AND METHODS FOR COMPACTING WASTE

FIELD OF THE INVENTION

The present invention concerns improvements to an apparatus for treating organic waste of various types, like vegetables, fruit and other food waste. By using the apparatus of the invention fine grinding and compacting of the waste occurs before the waste is delivered to a public collection centre. Consequently, the volume of the waste is reduced, which limits the environmental impact, limits the remaining humidity of the ground waste to avoid bacteria, and avoids fermentation and bad odours. Furthermore, the apparatus makes it possible to accomplish differentiated collection of the waste and to produce compost.

BACKGROUND OF THE INVENTION

An apparatus of this type needs to be suitable for a practical use, which comprises the steps of introducing the waste to be ground, grinding the waste, compacting and squeezing the ground waste to extract the residual liquids, therefore to reduce the volume and achieve the dehumidification of the waste. Finally, the treated waste needs to be discharged without manually intervening on it.

The apparatus of DE 317 788 mixes and possibly breaks portions of substances with agitator 17. This apparatus is not suitable for treating ground waste that is cut by using cutting blades.

The apparatus needs to be easily emptied of the waste, when the apparatus needs to be stopped for long periods of inactivity.

The movement mechanisms of the apparatus need to be reliable and simple to guarantee a long life of the apparatus and a minimum amount of maintenance operations.

Furthermore, the apparatus needs to allow facilitated cleaning to remove remaining waste, when the apparatus is emptied for long periods of inactivity. This problem is particularly felt when compacting organic kitchen waste present in homes, refectories, restaurants, etc., where frequent disinfection of the machine is necessary to avoid bad odour and bacterial presence.

SUMMARY OF THE INVENTION

It is therefore an object of the invention to provide an apparatus for treating waste, in particular organic waste, which overcomes the above mentioned problems.

It is a further object of the invention to provide an apparatus for treating waste, which is capable of improving the compacting step and the dehumidification of the waste, thereby achieving an optimal separation of the liquid parts from the solid parts.

It is a further object of the invention to provide an apparatus for treating waste in which compacting and extraction of remaining liquids occurs and that can be easily emptied of the waste when the apparatus needs to be stopped for long periods.

It is also an object of the invention to provide an apparatus for treating waste where ordinary maintenance can be easily carried out and allowing facilitated extraction and cleaning of the parts where passage of the waste occurs.

These and other objects are achieved by the apparatus and the method for treating the waste according to the independent claims appended hereto. Further characteristics are defined by the dependent claims appended hereto.

BRIEF DESCRIPTION OF THE DRAWINGS

Further characteristics and advantages of the apparatus and the methods according to the invention will be clearer from the description which follows, in which:

FIG. 3 is a partial prospective view of a portion of the apparatus, as seen from direction 3 of FIG. 1;

FIG. 4 is a partial section of portion 4 of FIG. 2, illustrating a second embodiment of the invention;

FIG. 5 is a partial view from directions 5-5 of FIG. 2;

DESCRIPTION OF THE PREFERRED EMBODIMENTS

Figure 1:
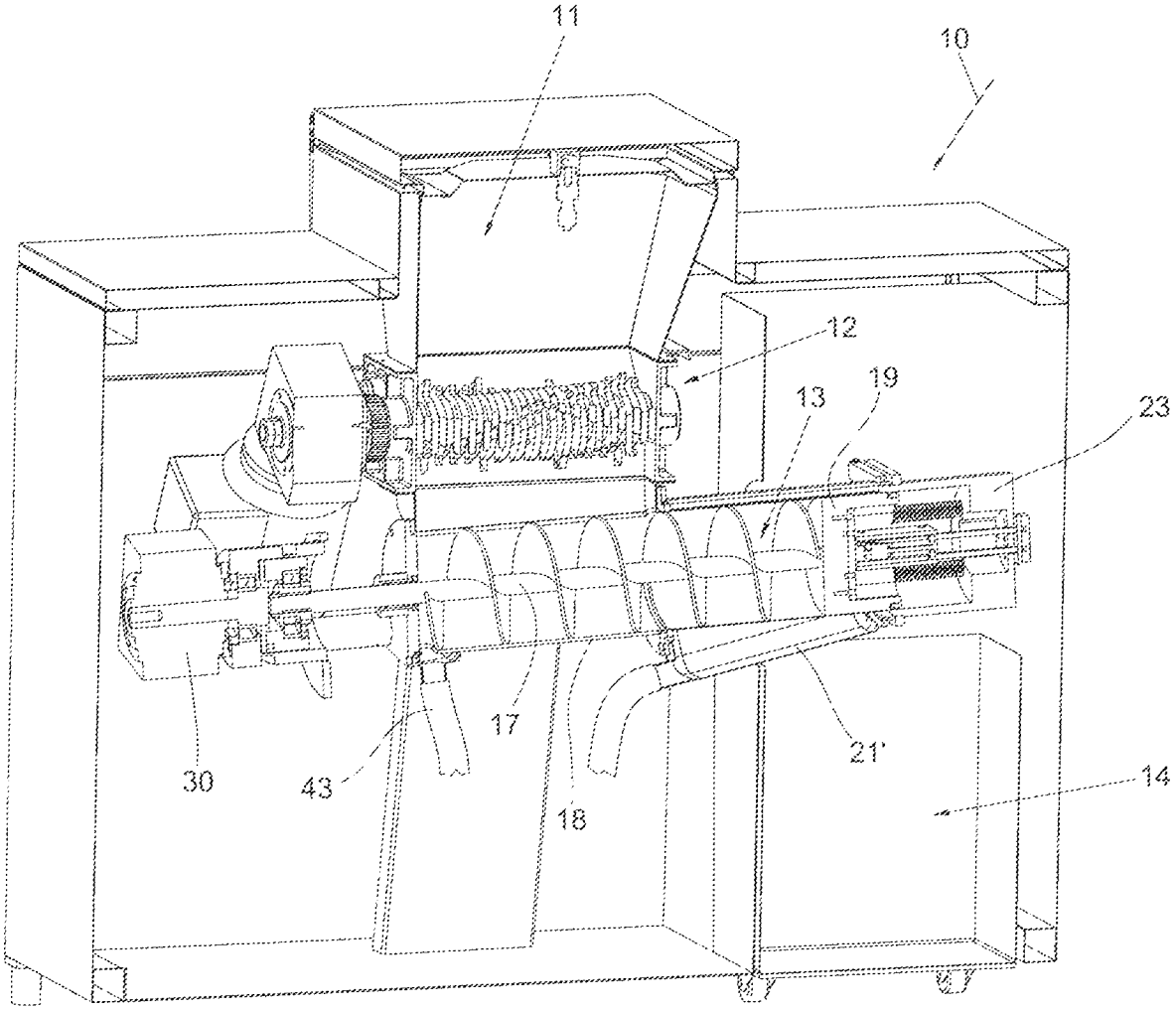
FIG. 1 is a general partial section view of the apparatus according to the invention.
Figure 2:
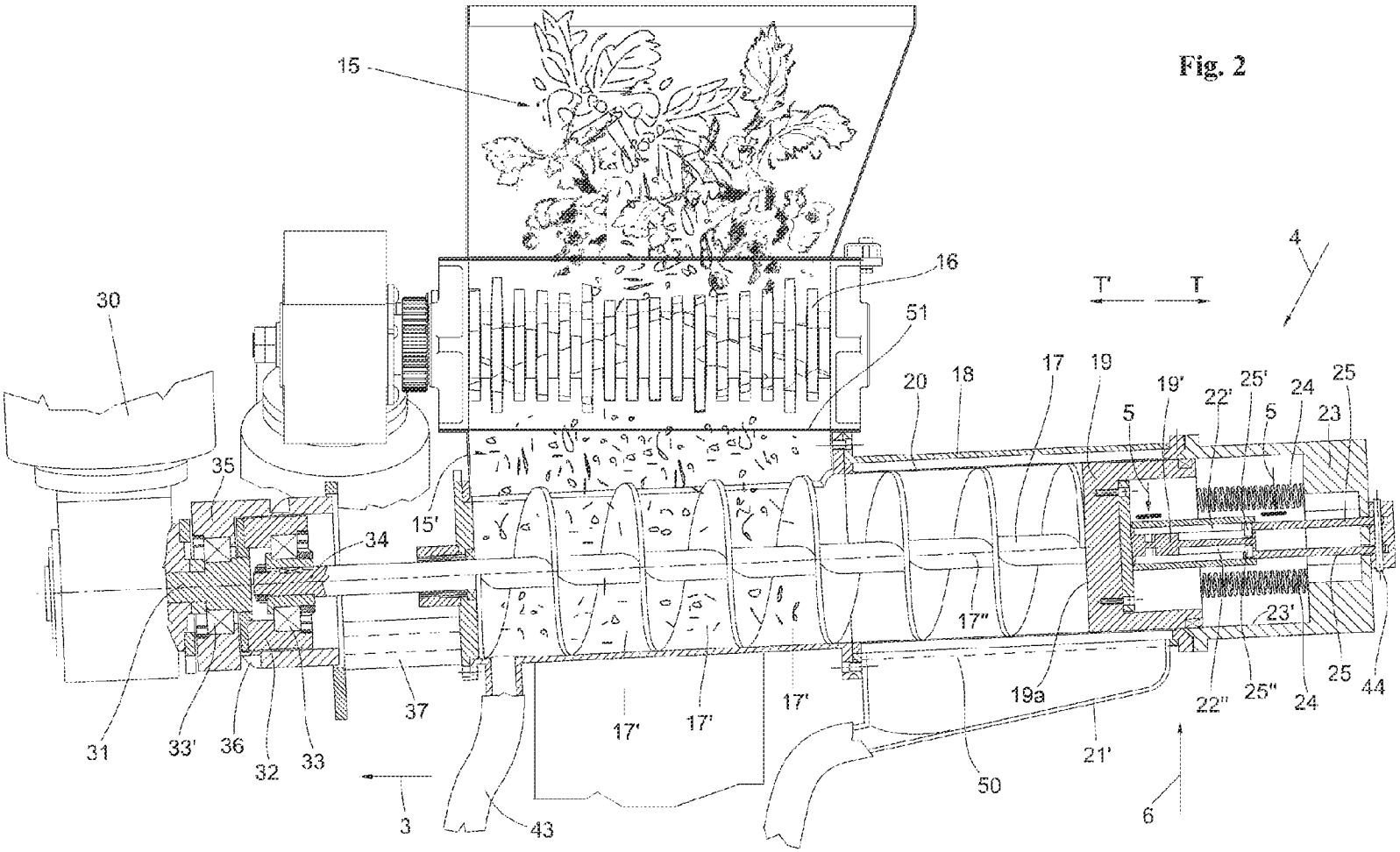
FIG. 2 is an enlarged view of the sectioned part of the apparatus shown in FIG. 1, although showing the lid of the machine in an open position and with the waste to be treated that has been introduced in the loading section.

With reference to FIGS. 1 and 2, an apparatus 10 for treating waste, in particular organic waste, comprises from top to bottom a loading section 11, a grinding section 12, a waste compacting and dehumidification section 13, and a section 14 for collecting the treated waste.

A possible succession of working steps of the apparatus starts when the loading section 11 is opened for introducing the waste 15 to be treated (see FIG. 2)

The loaded waste 15 falls into the grinding section 12. This section is provided with grinding means 16, for example a series of blades located on the periphery of two drums which rotate opposite to each other, like those described in Italian Patent Application PI 2007A000050, to accomplish fine grinding of the waste. Below the grinding means 16, the ground waste falls through aperture 15' of casing 18 into the vanes 17' of a helical screw device 17.

Helical screw device 17 is provided with a longitudinal axis 17' within casing 18 and is capable of rotating around this longitudinal axis. The rotation of helical screw device 17 conveys ground material against and in front of a wall 19*a* of a closure 19 (see FIG. 6*a*-6*d*).

As the material M progressively accumulates against the closure 19, relative movement of the closure 19 occurs with respect to the helical screw device 17 along a path that is substantially parallel to the axis of the helical screw device 17.

In the embodiment of FIGS. 1 and 2, the closure 19 moves backwards in direction T due to the force applied on closure 19 by the ground material positioned in front of it and that is being pushed by the screw portion of helical screw device 17.

In this way, the material M in front of closure 19 undergoes a compression action, which compacts and squeezes it to cause residual liquid to be extracted. During compacting no discharge of the compacted waste occurs.

For these reasons, a bored casing 20 is provided inside the final portion of casing 18 where the material M accumulates to allow liquid to be extracted as the squeezing occurs.

Casing 18 is provided with an exit 50 connected to a conveying duct 21' through which liquid 21 is discharged from the apparatus.

Closure 19 is provided with a rear part 19' (see FIGS. 2 and 5) where two shaped grooves 22' and 22" are foreseen. Shaped groove 22' on the top side of rear part 19' is shown in FIG. 5. Shaped groove 22" is present on the lower side and is similar to shaped groove 22'. In each shaped groove 22' and 22", a respective pin 25' and 25" is engaged as shown in FIGS. 2 and 5. Groove 22' comprises a first straight part 22*a*, an inclined part 22*b*, a transverse part 22*c* and a second straight part 22*d*. Pins 25' and 25" are the ends of arms 25 which are hinged to cover 23 by means of pin (see FIG. 2).

Therefore pins 25' and 25" have the possibility of moving in the plane that is perpendicular to the plane containing FIG. 2, i.e. like the plane containing FIG. 5.

Closure 19 is guided by the engagement of its external surface against the internal surface 23' of cover 23 as the latter moves in directions T and T', as shown in FIG. 2. Springs 24 that are preloaded with a compression force and placed between cover 23 and closure 19 push closure 19 in direction T', which is opposite to direction T. In this way, there has been achieved one of the possible embodiments provided by the invention of the means for guiding that allow a translation movement of closure 19 along the axis 17" of the screw device 17, and of the contrast means located beyond the closure 19 and opposite to the screw device 17. When the screw device 17 pushes on material M that is accumulated in the volume of the casing in front of closure 19, springs 24 exert an opposite force on member 19.

The two opposite forces obtained in this manner accomplish squeezing extraction of liquid 21 and compacting of material M.

Figure 6A:
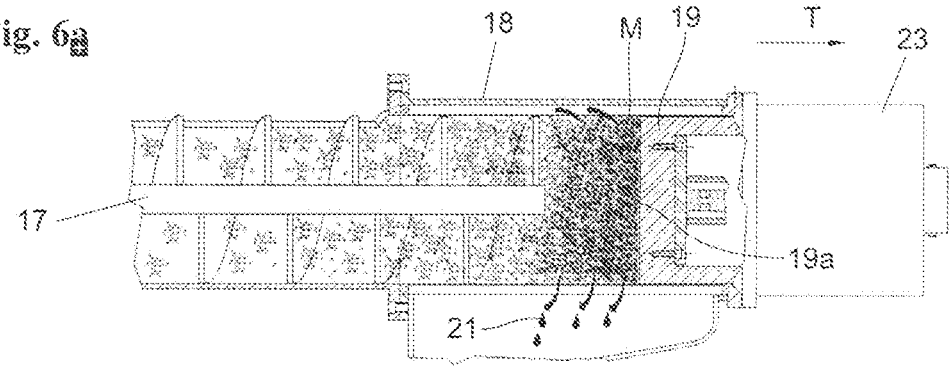
FIGS. 6*a* to 6*f* are partial section views of area 6 of FIG. 2 illustrating operation cycles of the apparatus according to the invention.
Figure 6B:
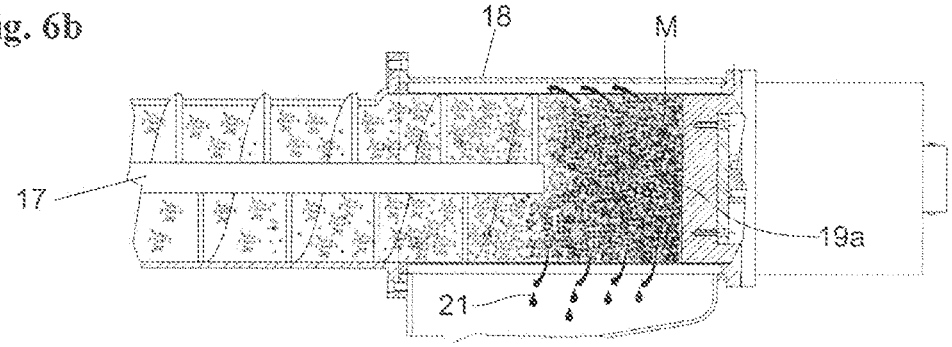
Figure 6C:
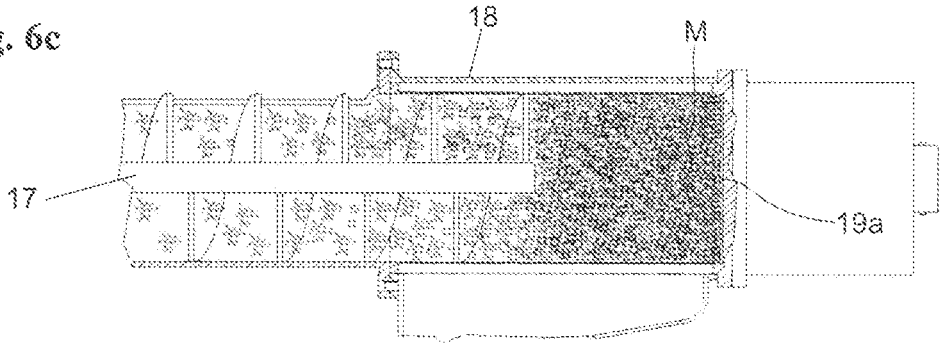

During this sequence of forces, see FIGS. 6*a* and 6*b*, during a first backward movement step of closure 19 in direction T, pins 25' and 25" move in the straight portion 22*a* of the shaped guide 22' of part 19'. During a second step of the backward movement of closure 19, pins 25' and 25" move in the inclined part 22*b*, and during the final step of the backward movement of closure 19, pins 25' and 25" move in the transverse parts 22*c*.

When pin 25' or pin 25" are in the transverse parts 22*c*, a situation signalled by a sensor not shown in the figures, the rotation of the screw device 17 is stopped. At the same time pins 25' and 25" become located in the position that causes an engagement connection of the closure 19 to cover 23, see the position of pin 25' shown in FIG. 5.

As a result, closure 19 is no longer free to move with respect to cover 23 due to engagement of pins 25' and 25" in the seat portion of groove 22*c*, which renders closure 19 and cover 23 connected and integral, as shown in FIG. 5 for pin 25'.

Figure 6D:
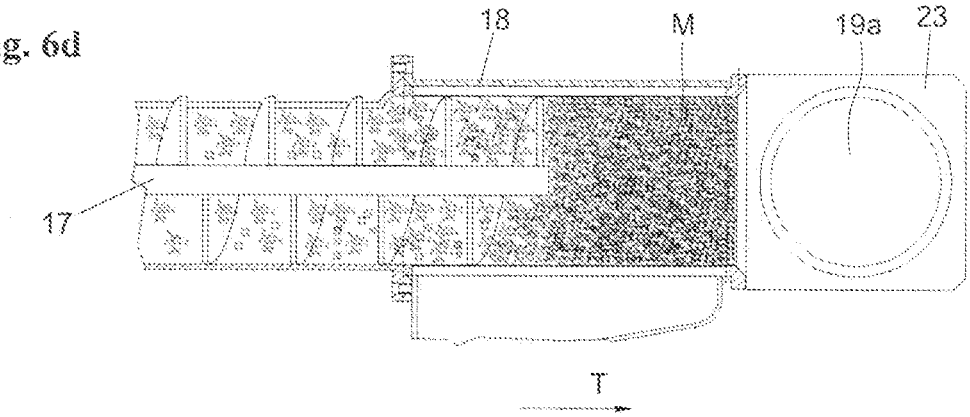

At this point cover 23 can be opened and closure 19 moves with it to free the exit opening 18' of casing 18 to discharge the compacted material M, as shown in FIG. 6*d*.

Figure 6E:
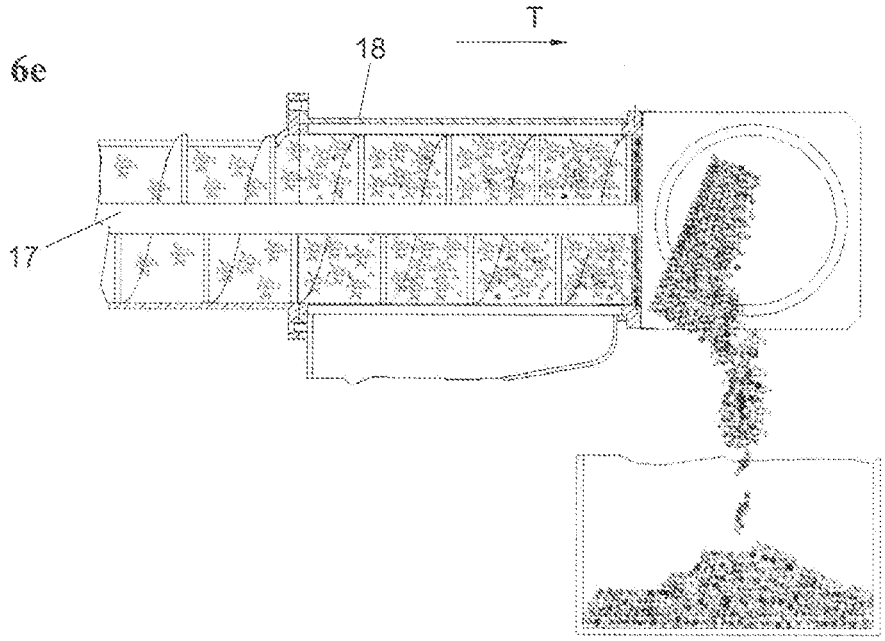

Then, screw device 17 translates in direction T to push the compacted material M through the exit opening 18" out of casing 18, as shown in FIG. 6*e*.

Figure 6F:
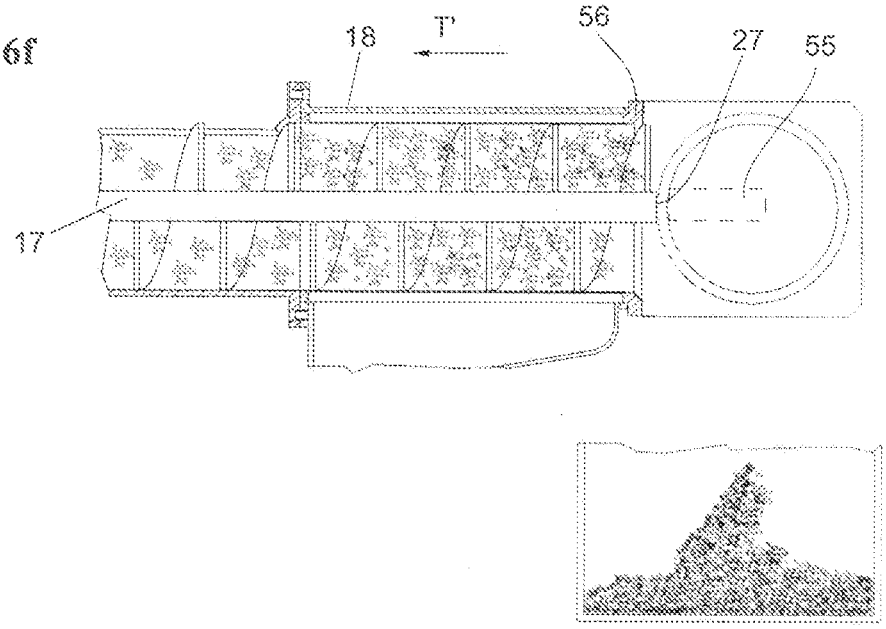

During the translation, screw device 17 is guided by the internal surface of casing 18. At the end of the travel of the screw device 17 in direction T, end 27 of the screw device reaches the position that extends beyond the edge of the end of casing 18, as shown in FIG. 6*f*.

Once material M has been unloaded, cover 23 is closed to start a further step of squeezing and compacting. During the travel of cover 23 to be closed, closure 19 engages the end 27 of screw device 17. During this engagement and the travel of cover 23 to become closed, pins 25' and 25" become free from the seats of the transverse parts like 22*c* of shaped grooves 22' and 22", and consequently closure 19 becomes disconnected from cover 23.

At this point, cover 19 follows the backward movement of screw device 17 in direction T' because closure 19 is being pushed by springs 24, whilst the end 27 of screw device 17 acts like a moving engagement surface to withhold uncontrolled backward movement of closure 19.

During the backward movement in direction T', pins 25' and 25" relatively move in stretches like 22*d* and 22*a*.

For the steps described in the foregoing where the cover 23 is opened and closed, to remove or replace closure 19, a drive mechanism 55 (dash line representation in FIG. 6*f*) is provided which rotates cover 23 around a hinge mechanism 56 of casing 18, as shown in FIGS. 6*d*-6*f*.

The complete closure of lid 23 and the backward movement of the screw device 17 in direction T' bring closure 19 in the most forward position (see FIG. 2) to repeat the squeezing and compacting cycle by using rotation of screw device 17.

With reference to FIGS. 2 and 3, the screw device 17 is rotated by actuating the motor reduction drive 30 with a rotation direction that causes pushing action of screw device 17 on material M.

Drum 32 is assembled in a fixed manner on the end of exit shaft 31 of motor gear drive 30, visible in FIG. 2 however not visible in FIG. 3 for reasons of clarity.

The free wheel 33 is assembled between drum 32 and end 34 of screw device 17, as shown in FIG. 2. The rotation direction of the motor reduction drive 30 causes the pushing action on behalf of the screw device 17, and consequently also the direction that the free wheel 33 uses for transmitting the rotation torque of screw device 17.

During the opposite rotation of the motor reduction drive 30 (opposite rotation in the following), the freewheel 33 remains idle, which makes drum 32 idle with respect to end 34 of the screw device 17. Therefore no rotation torque is transmitted, thereby excluding rotation of screw device 17 during opposite rotation of motor reduction drive 30.

The free wheel 33' is assembled between drum 35 and the exit shaft 31 of motor reduction drive 30. The external surface of drum 35 is provided with groove 36, which has a cam profile. The motor reduction drive 30 is provided with bars 38 (see FIGS. 2 and 3) that can run in supports 37 of the frame of the apparatus.

The roller 39 of an arm fixed to the frame of the apparatus can engage the internal surfaces of groove 36 (see FIG. 3). Therefore when motor reduction drive 30 rotates with the opposite rotation, the free wheel 33' transmits rotation torque to drum 35 and groove 36 rotates when the roller 38 is engaged with it. This causes translation in direction T or T' of the motor reduction drive 30 and the screw drive 17 that is integral to it. Depending on the stretch of groove 36 which is travelled by roller 39 the translations occur in direction T and T' of screw drive 17, as is required in the cycles described in the foregoing with reference to FIGS. 6*e* and 6*f*.

Based on the principles described above and with reference to FIGS. 6*e* and 6*f* the result is that the apparatus can easily be emptied of the waste that is present inside, and particularly when the apparatus needs to be stopped for long periods of time.

The possibility of being able to remove closure 19 favours access to the area of casing 18 where the compacting and the squeezing of residual liquid occurs. In this way the operations to remove remaining waste and cleaning becomes facilitated.

As shown in FIG. 2, casing 18 results slightly inclined with respect to the horizontal plane. This creates a slope that allows a part of the liquid 21 present in casing 18 to flow towards exit 43 (see FIG. 1). This liquid can be present in the material conveyed by the screw device or other liquid poured into the loading section 11.

FIG. 4 shows a second embodiment of the cover 23. In this case, closure 19 is moved in directions T and T' by an actuator 41 that is integral with cover 23. Actuator 41 pushes or pulls shaft 40, which is assembled integral with closure 19. Actuator 41 is connected to the drive and control unit 42. Sensor 45 is also present for measuring the displacement of closure 19, or the force exerted on closure 19 during compacting.

By means of particular movements of closure 19 or force reactions of closure 19 produced by actuator 41, and which are programmed and controlled by unit 42, it is possible to optimize compacting of the material M and squeezing of liquid 21.

In the above mentioned description, the movement of closure 19 with respect to screw device 17 has been created in opposition to the force of preloaded spring 24, or by the force exerted using actuator 41. Other equivalent means are available in the art for generating the force opposing the movement of closure 19, for example viscous dampers, or elastic dampers or a combination of these.

Figure 7:
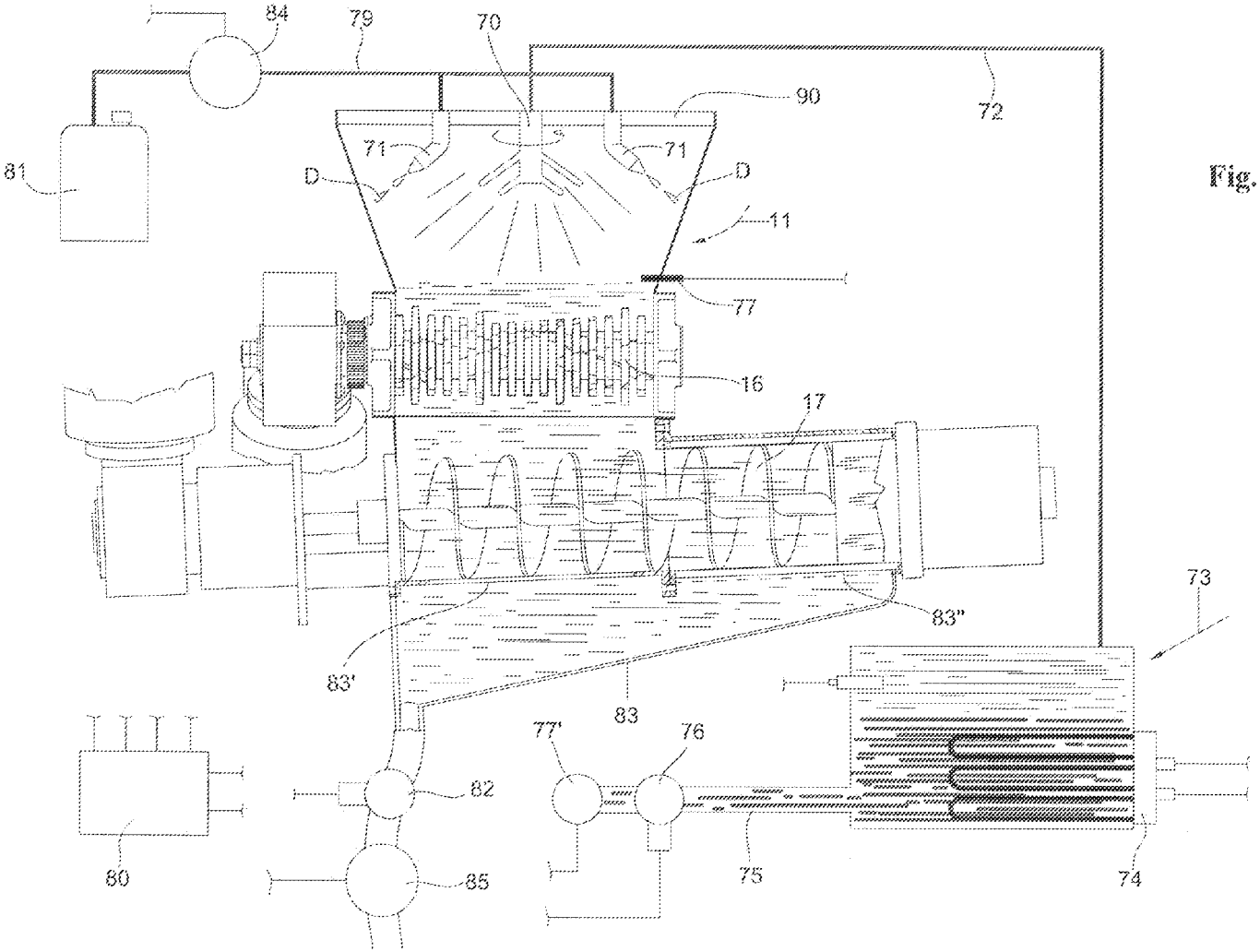
FIG. 7 is a view similar to the view of FIG. 2 illustrating a solution for cleaning the apparatus according to the principles of the invention.

FIG. 7 illustrates a solution for cleaning the apparatus once the waste has been emptied by following the principles described with reference to FIGS. 6*d*-6*f*.

A sprinkler device 70 and detergent dispenser devices 71 can be assembled on the lid 90 of loading section 11 as shown in FIG. 7. Valve 82 intercepts any discharge of liquid from collector 83. Collector 83 is foreseen for receiving liquid leaving casing 18 though apertures 83' and 83" during normal operations of the machine. Sprinkler device 70 is connected by piping 72 to liquid reservoir 73. Liquid reservoir 73 can receive water or other cleaning liquid from supply piping 75 and can be provided with a heating resistance 74 for heating the liquid that needs to reach sprinkler device 70. Valve 76 intercepts the flow of liquid through piping 75. By opening valve 76 heated liquid from reservoir 73 passes to sprinkler device 70, which rotates and dispenses heated liquid in loading section 11. During dispensing of the liquid, valve 82 can be closed to avoid discharge from collector 83. The sprinkler device can continue to dispense the liquid to reach the condition that screw device 17 and the grinding means 16 are submerged, like is shown in FIG. 7. A level sensor like 77 can determine when the liquid has reached the submerging level shown in FIG. 7, and causes control 80 to close valve 76. As an alternative to the use of sensor 77, or combined with the use of sensor 77, a flow sensor 77' can measure the flow of liquid reaching reservoir 73, which indirectly is a measure of the flow of liquid being sprayed by sprinkler 70. Controls 80 receiving the measurement signal from sensor 77' can determine when a predetermined quantity of liquid has been discharged in the apparatus after discharge vale 82 has been closed. Based on this determination valve 76 can be closed to continue the cleaning sequence of the apparatus.

Detergent D can also be dispensed by detergent dispenser devices 71 on the walls of loading section 11, as shown in FIG. 7. Detergent D is fed from tank 81 through piping 79 by pump 84. Detergent D can be a cleaning and sanitizing solution for guaranteeing optimal conditions of sanitary safety.

When the submerging level sensed by sensor 77 and controls 80 has been reached, or a predetermined level of liquid has been fed through sprinkler 70 sensed by flow sensor 77' in combination with controls 80, and after a certain period of waiting time, grinding means 16 and screw device 17 can be rotated to favour cleaning and detachment of waste from the surfaces of the apparatus. Once this step of rotation has been terminated, valve 82 can be opened and pump 85 activated to discharge the liquid. After this discharge has occurred, screw device 17 can be rotated to convey any detached waste against closure 19. Then screw device 17 can be caused to travel in direction T to push closure 19 in direction T and cause it to become connected to cover 23 by means of pins 25' and 25", as described in the foregoing. This situation can allow cover 23 to be opened so that screw 17 can move further in direction T to discharge the detached waste.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. Apparatus for treating food waste in a kitchen environment, the apparatus comprising:

a container for receiving the waste to be treated;

cutting blades for grinding said waste to obtain ground waste;

a worm screw disposed inside a casing, said worm screw rotating around a longitudinal axis for conveying and compacting said ground waste against a wall of a closure;

a cover that guides movement of said closure inside said casing with respect to said worm screw during compacting due to the compression force exerted by said worm screw, while preventing discharging of compacted waste;

a force dampener that applies an opposing force on said closure during movement of said closure;

a drive mechanism that removes said closure from said casing to form an exit opening at an outlet end of said casing to allow discharge of compacted waste; and a drive assembly that displaces said worm screw parallel to the longitudinal axis toward the exit opening to discharge said compacted waste out of said casing.

2. The apparatus of claim 1 wherein said force dampener is selected from the group consisting of: an actuator, a viscous dampener, an elastic dampener, and combinations thereof.

3. The apparatus of claim 1 comprising a sensor for supplying a stop signal to means for rotating said worm screw, said sensor being selected from the group consisting of:

a position sensor that supplies said signal when the movement of said closure with respect to said worm screw has reached a predetermined displacement, and a force sensor that supplies said signal when a predetermined force has been applied to said closure.

4. The apparatus of claim 1 wherein said drive assembly comprises:

a cam assembly comprising a cam and a cam follower that follows said cam;

a motor for moving said cam relative to said cam follower, said motor rotating in a first direction to translate said worm screw;

a first freewheel for transmitting said rotation of said motor to said cam assembly.

5. The apparatus of claim 4 wherein said motor also rotates said worm screw to compact said ground waste; the motor rotating in a second direction to rotate said worm screw, said rotation in said second direction being transmitted to said worm screw through an assembly comprising a second freewheel.

6. The apparatus of claim 4 comprising guides for supporting displacement of said motor, and of said cam with the first freewheel, along a path parallel to said longitudinal axis during said rotation in said first direction.

7. The apparatus of claim 2 further comprising a releasable locking device for locking the closure at the end of said movement.

8. The apparatus of claim 1 comprising a casing structure for containing liquid extracted from the ground waste during compacting and a member for passage of said liquid; wherein the member for passage of said liquid surrounds the worm screw and is located inside a portion of the casing proximate to said closure.

9. A method for treating food waste in a kitchen environment, said method comprising:

containing the waste to be ground;

grinding the waste using cutting blades to form ground waste;

rotating a worm screw inside a casing around a longitudinal axis for conveying and compacting ground waste against a wall of a closure;

causing a movement of said closure inside said casing with respect to said worm screw during compacting against said closure resulting from compression force exerted by said worm screw against the closure, while preventing discharging of compacted waste;

opposing the movement of said closure with respect to the worm screw;

removing the closure from the casing to form an exit opening at an outlet end of the casing to discharge compacted waste; and displacing said worm screw parallel to the longitudinal axis toward the exit opening during the discharging to push the compacted waste out of said casing.

10. The method of claim 9 further comprising stopping said rotation of said worm screw, said stopping occurring when said movement of said closure with respect to said worm screw has caused a condition selected from the group consisting of:

occurrence of a predetermined displacement of the movement of said closure with respect to said worm screw, and application of a predetermined force to said closure.

11. The method of claim 9 further comprising locking the closure in a predetermined position prior to said removing said closure.

12. The method of claim 9 further comprising engaging the closure against said worm screw to release locking when re-positioning the closure.

13. The apparatus of claim 1 further comprising:

a liquid cleaning reservoir for accumulating cleaning liquid;

a liquid dispenser disposed in the container that dispenses the cleaning liquid;

a supply mechanism that delivers the cleaning liquid from the reservoir to the liquid dispenser;

a valve for selectively impeding exit of said cleaning liquid from the casing;

a controller that determines the quantity of cleaning liquid filled in the casing.

14. The method of claim 9 further comprising:

filling the casing with a predetermined quantity of cleaning liquid;

avoiding discharge of the cleaning liquid from the casing when the predetermined quantity of cleaning liquid has been filled;

rotating at least said worm screw prior to discharging the cleaning liquid from the casing.

15. The method of claim 14 further comprising opening said closure after discharging the cleaning liquid from the casing, and translating said worm screw to discharge any residual waste.

* * * * *